US005669039A

United States Patent [19]

Ohtsuka et al.

[11] Patent Number: 5,669,039

[45] Date of Patent: Sep. 16, 1997

[54] IMAGE HEATING APPARATUS CAPABLE OF VARYING FEEDING INTERVALS BETWEEN RECORDING MATERIALS

[75] Inventors: Yasumasa Ohtsuka; Kouichi Okuda, both of Yokohama; Yohji Tomoyuki, Ichikawa; Akira Hayakawa; Daizo Fukuzawa, both of Tokyo, all of Japan

[73] Assignee: Canon Kabushiki Kaisha, Tokyo, Japan

[21] Appl. No.: 720,470

[22] Filed: Sep. 30, 1996

Related U.S. Application Data

[63] Continuation of Ser. No. 543,524, Oct. 16, 1995, abandoned, which is a continuation of Ser. No. 151,751, Nov. 15, 1993, abandoned.

[30] Foreign Application Priority Data

Nov. 13, 1992 [JP] Japan ..... 4-328837

[51] Int. Cl.[6] ..... G03G 15/20

[52] U.S. Cl. ..... 399/68; 399/400

[58] Field of Search ..... 399/33, 45, 67, 399/68, 328, 329, 400

[56] References Cited

U.S. PATENT DOCUMENTS

| | | | |
|---|---|---|---|
| 4,416,534 | 11/1983 | Klugen | 355/208 X |
| 4,719,489 | 1/1988 | Ohkubo et al. . | |
| 5,130,750 | 7/1992 | Rabb | 355/208 |
| 5,148,226 | 9/1992 | Setoriyama et al. | 355/290 |
| 5,149,941 | 9/1992 | Hirabayashi et al. . | |
| 5,153,654 | 10/1992 | Yuminamochi et al. . | |
| 5,171,145 | 12/1992 | Kusaka et al. | 355/290 X |
| 5,177,549 | 1/1993 | Ohtsuka et al. . | |
| 5,184,185 | 2/1993 | Rasmussen et al. | 355/308 |
| 5,303,015 | 4/1994 | Sato | 355/285 |
| 5,307,133 | 4/1994 | Koshimizu et al. | 355/285 |
| 5,552,874 | 9/1996 | Ohtsuka et al. | 399/335 |

FOREIGN PATENT DOCUMENTS

| | | |
|---|---|---|
| 362791 | 4/1990 | European Pat. Off. . |
| 402143 | 12/1990 | European Pat. Off. . |
| 415752 | 3/1991 | European Pat. Off. . |
| 534417 | 3/1993 | European Pat. Off. . |
| 57-014866 | 1/1982 | Japan . |
| 60-041050 | 3/1985 | Japan . |
| 61-018983 | 1/1986 | Japan . |

OTHER PUBLICATIONS

"Fusing Offset Masters", Brandon, et al., IBM Technical Disclosure Bulletin, vol. 23, No. 10, p. 4432 (Mar. 1981).

*Primary Examiner*—Matthew S. Smith

*Attorney, Agent, or Firm*—Fitzpatrick, Cella, Harper & Scinto

[57] ABSTRACT

An image heating apparatus includes a heater which is stationary in use; a film slidable on the heater; a backup member cooperable the heater to form a nip, with the film being interposed between them, an image carried on a recording material being heated through the film in the nip by heat from the heater; and a feeding interval controlling device for varying the recording material interval with which the recording materials are consecutively fed.

7 Claims, 5 Drawing Sheets

IMAGE HEATING APPARATUS CAPABLE OF VARYING FEEDING INTERVALS BETWEEN RECORDING MATERIALS

This application is a continuation of application No. 08/543,524, filed Oct. 16, 1995, now abandoned, which is a continuation of application No. 08/151,751, filed Nov. 15, 1993, now abandoned.

FIELD OF THE INVENTION AND RELATED ART

The present invention relates to an image heating apparatus for fixing an image on a recording material or altering the surface properties of the recording material. More specifically, the present invention relates to an image heating apparatus in which the image is heated through a piece of film.

In U.S. Pat. Nos. 5,149,941, 444,802, 712,532, and 5,148,226, image heating apparatuses are proposed in which the image carried on the recording material is heated through contact with a piece of heat resistant film, one surface of which comes in contact with the recording material and the other surface of which remains in contact with a heater.

FIG. 9 depicts the general structure of the image heating apparatus of a through-film heating type.

This particular heating apparatus comprises an endless belt of heat resistant fixing film 1, a driving roller 11 on the left side, a follower roller 12 on the right, a heater 6 which is a linear heating member of a small thermal capacity, and is fixedly supported below the substantial middle point between these two rollers, wherein the fixing film 1 is stretched around the three members 11, 12, and 6 which are arranged in parallel to each other.

As the driving roller 11 rotates in the clockwise direction, the fixing film 1 is rotated in the clockwise direction at a predetermined peripheral velocity which is the same as the speed at which a recording material P, that is, a material to be heated, is conveyed, carrying on the upper surface an unfixed toner image Ta which is delivered from an nnshown image forming station. The follower roller 12 doubles as a tension roller so that the endless fixing film 1 is rotatively driven without wrinkling, snaking, or delaying.

A reference numeral 2 is a pressure roller as a pressing member, comprising an elastic rubber layer such as silicone rubber excelling in parting properties. The endless fixing film 1 is sandwiched between the heater 6 and the pressure roller 2, being pressed on the bottom surface of the heater 6 by the pressure roller 2 with an overall contact pressure of 4–7 kg generated by a pressure generating means, wherein the pressure roller 2 rotates in the counterclockwise direction, that is, the direction in which the recording material P is conveyed.

Since the endless fixing film 1 is repeatedly used to fixing thermally the toner image as it is rotatively driven, monolayer or multilayer film excelling in heat resistance, parting properties, and durability is used. Generally speaking, its overall thickness is less than 100 μm, preferably no more than 40 μm.

The heater 6 as the heating member in this apparatus basically comprises a heater substrate 3, an exothermal layer 5, and a heater temperature detecting element 4 (for example, thermistor); wherein the heater substrate 3 is insulating and highly heat resistant, and has a low thermal capacity, and its longitudinal direction is perpendicular to the direction in which the recording material P is conveyed; the exothermal layer 5 is printed on the heater substrate 3 in the longitudinal direction of the substrate 3; and the heater temperature detecting element 4 is placed in contact with the heater substrate 3, on the surface opposite to where the exothermal layer is formed. The heater 6 is fixedly supported in an insulated manner by a heater holder 7, with the exothermic layer side being exposed, and the overall thermal capacity of the heater 6 is small.

The heater substrate 3 is a piece of aluminum substrate, for example, which is 1 mm thick, 6 mm wide, and 240 mm long, or a piece of composite substrate comprising the same.

The exothermic layer 5 is composed of electrically resistant material such as Ag/Pd, $RuO_2$, $Ta_2$ coated (for example, printed) 1 mm wide on the heater substrate 3, in the substantial middle of the bottom surface, along the longitudinal direction of the substrate 3. The power is supplied as a voltage applied between power supply electrodes connected to opposite ends of the exothermic layer 5.

As for the temperature control of the heater 6, the power supply to the exothermal layer 5 is controlled in a manner to keep constant the temperature of the heater 6 detected by the thermistor 4.

The thermistor 4 is situated at a position which falls within the sheet passage regardless of the size of the sheet (recording material size) being fed, so that the temperature of the heat 6 becomes constant within the sheet passage.

The heater 6 may be covered by a thin surface protection layer such as heat resistant glass, on the surface where the exothermic layer 5 is formed, to prevent wear damage caused by the film 1 which slides on the surface while being rotatively driven. Further, a lubricant mat be coated on the heater 6, on the surface in contact with the sliding film.

An image forming process is started by an image formation start signal and is carried out in an unshown image forming station, wherein the recording material P delivered to a fixing apparatus is guided by an entrance guide 8 into a pressure nip N (fixing nip) formed between the temperature-controlled heater 6 and pressure roller 2, between the fixing film 1 and the pressure roller 2, and is passed through the nip while being subjected to the compressing force of the fixing nip N, as if being laminated with the fixing film, with the surface of the recording material P carrying the unfixed toner image being tightly pressed on the film 1, on the bottom surface, travelling at the same speed and in the same direction as the recording material P.

The tone image carrying surface of the recording material P is tightly pressed on the film 1 surface and receives, through the film 1, the heat from the heater 6 while the recording material P is passed through the fixing nip N, whereby the toner image is softened and fused as Tb on the surface of the recording material P. The recording material P and film 1 are separated as the recording material P comes out of the fixing nip N.

While the recording material P separated from the film 1 is guided by a guide 9 to a pair of unshown discharge rollers, the toner Tb having a temperature higher than the glass-transition point naturally cools down to become a solid Tc having a temperature lower than the glass-transition point, and then, the recording material P having a fixed image is discharged.

In such an apparatus, the heater temperature is detected by the thermistor 4, as the temperature detecting element, situated on the heater 6, on the portion which falls within the sheet passage regardless of the sheet size, and the power supply is controlled to keep constant the thus detected temperature; therefore, when small size sheets such as B5 size printing paper, envelopes, or postcards are consecutively fed, the temperature difference across the heater 6 exceeds 50 degrees between the sheet passage and non-sheet passage portions.

Therefore, the difference in the external diameter of the pressuring member 2 reaches as much as several hundreds of micron, between the sheet passage and non-sheet passage portions. As a result, the speed at which the film is rotated becomes different between the left and right sides, causing thereby the film to be twisted to be broken, or causing a large size sheet such as A size paper to be wrinkled if it is fed immediately after the difference occurs.

Further, when such a condition lasts, the pressuring member 2 or film 1 is deteriorated by the heat, shortening thereby the durabilities of the components, or in the worst case, damaging the apparatus itself.

Therefore, it is considered, as disclosed in U.S. Pat. No. 786556, to prepare two or more heating generating patterns for the heater to reduce the amount of heat generated in the non-sheet passage portion, corresponding to the different sheet sizes. However, this arrangement requires a complicated heater, which lowers manufacturing efficiency.

SUMMARY OF THE INVENTION

The primary object of the present invention is to provide an image heating apparatus capable of preventing the excessive temperature increase in the non-sheet passage portion of the heater.

According to an aspect of the present invention, the thermal deterioration or damage of the film or pressuring member is prevented.

Another object of the present invention is to provide an image heating apparatus comprising a stationary heater, a piece of film sliding on the heater, a backup member which coordinates with the heater to form a nip, with the film being interposed between them, and a means for varying the intervals between the recording materials when the recording materials are consecutively fed.

These and other objects, features and advantages of the present invention will become more apparent upon a consideration of the following description of the preferred embodiment of the present invention, taken in conjunction with the accompanying drawings.

DESCRIPTION OF THE PREFERRED EMBODIMENTS

Figure 1:
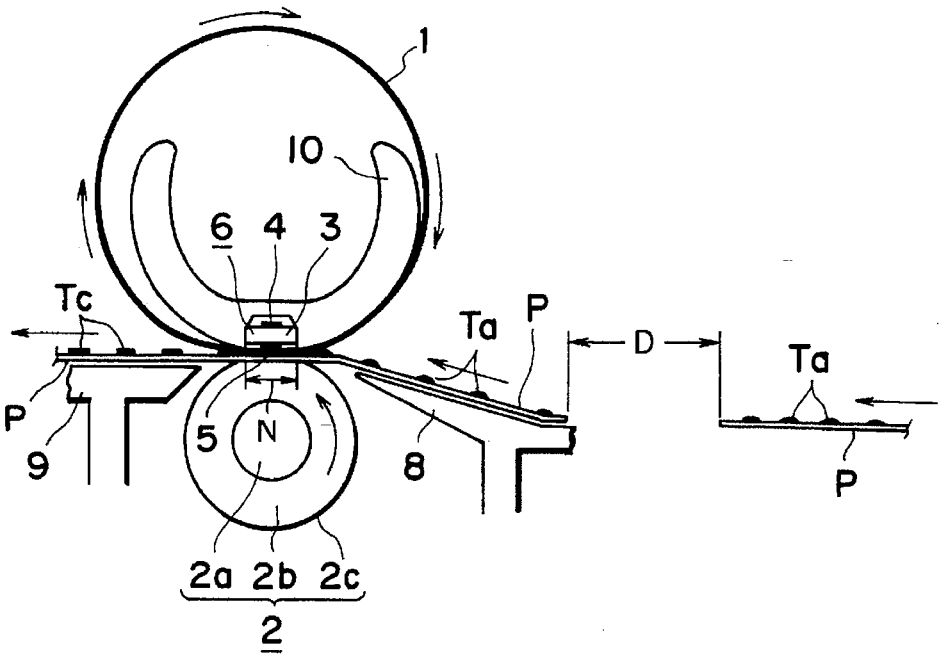
FIG. 1 is a sectional view of a preferred embodiment of the image heating apparatus in accordance with the present invention.

FIG. 1 is a sectional view of a preferred embodiment of the image heating apparatus in accordance with the present invention, which is a fixing apparatus for fixing thermally an unfixed image composed of toner particles.

A reference numeral 10 designates an internal film guiding member shaped like a trough, the cross-sectional configuration of which is substantially half a circle. A groove in which a heater is to be fitted is cut in this guiding member 10, substantially in the middle of the outward facing bottom surface, along the longitudinal direction of the guiding member. The heater is supported by being fitted in this groove. A cylindrical fixing film 1 is loosely fitted around the internal film guiding member 10 fitted with the heater 6. A pressure roller 2 is pressed on the heater 6, with the film 1 being interposed between them. As the pressure roller 2 is rotatively driven, the cylindrical fixing film 1 rotates around the internal film guiding member 10, sliding on the bottom Surface of the heater 6 while being tightly in contact with the surface.

Figure 9:
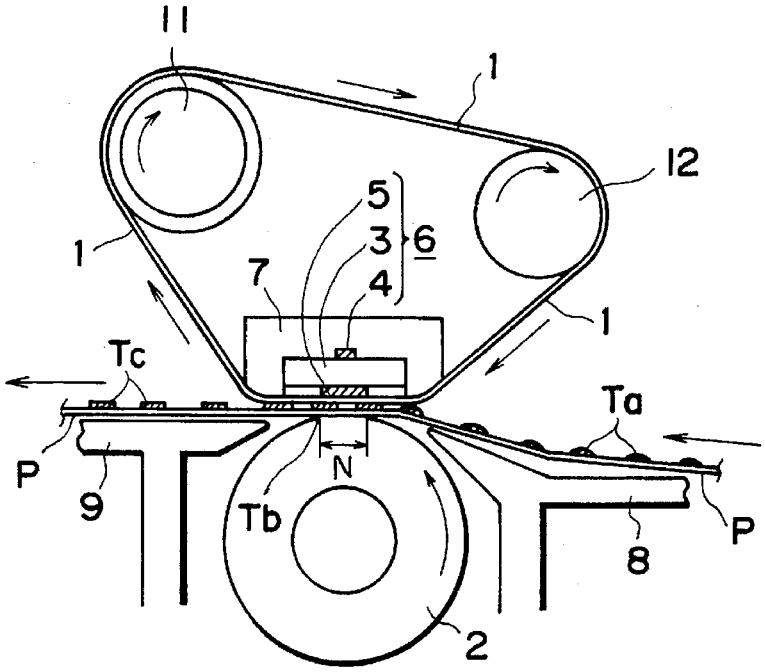
FIG. 9 is a sectional view of an image heating apparatus.

While the film is driven in this manner, a recording material P is introduced between the film 1 and pressure roller 2 and enters a fixing nip N. Just as it was the case in the apparatus shown in FIG. 9, while the recording material P passes the fixing nip N, the thermal energy of the heater 6 is given to the recording material P through the film 1, whereby the toner image is thermally fixed.

In a tension free type apparatus in which an endless film is loosely suspended in the above mentioned manner, tension is imparted on the film only in the portion in the fixing nip N and the portion in contact with the outward facing portion of the internal film guiding member 10, on the upstream side of the fixing nip with reference to the fixing nip N, and is not imparted on the rest of the film, which is the major portion of the film.

Therefore, the film shifting force is small, allowing a film shift movement regulating means and a film shift controlling means to be simplified. For example, a simple component such as a flange may be employed as the film shift movement regulating means to hold the film edge, and the film shift controlling means may be omitted, making it possible to reducing the apparatus cost and downsizing the apparatus.

As for the alignment of the recording material, a side of sheet is aligned with the sheet alignment reference at one lateral side regardless of the sheet size.

Fixing film 1:

A cylindrical polyimide film measuring 226 mm long, 24 mm wide, and 45 μm thick, the outward facing surface of which is coated 10 μm thick with PTFE. Heater 6:

A pattern of silver/palladium is screen-printed as an exothermic layer on an aluminum substrate 3 (heater substrate) measuring 6.5 mm wide, 236 long, and 0.635 mm thick, and then, is baked to create an exothermic resistor having a resistance value of 28.3 Ω. As for the thermistor 4, it is positioned on the heater substrate 3, on the back side (the surface opposite to the one where the exothermic layer 5 is present), 40 mm toward the sheet alignment reference from the longitudinal center of the substrate.

Pressure roller 2:

A 4 mm thick silicone rubber roller layer 2*b* is fitted over a stainless steel shaft 2*a* having an external diameter of 8 mm. As the surface layer 2*c*, fluorinated latex (GLS 213, a product of Daikin Industries, Ltd., containing FEP by 10 wt %) is coated 30 μm thick, and baked. The hardness is 50 degrees (Asker C).

Film driving speed (sheet conveyance speed):

23.8 mm/sec

A thermal fixing apparatus comprising the above members is installed in an image forming apparatus such as a printer or electrophotographic copying machine. When the sheets (recording materials) of the letter size or the A4 size are fed, the sheet interval D is set at steady 50 mm, but when the sheets of the smaller size such as the B5 or envelope size are fed, the sheet interval D is gradually increased as the count of the consecutively fed sheets increases.

It is made possible to identify the size of the sheet being fed, based on a signal from a feed cassette or a sheet selection signal from a host computer or the like, or with use of a sheet feed sensor or a registration sensor, and the above described sheet interval is automatically adjusted in response to the sheet size signal.

Embodiment 1

One hundred B5 size sheets were consecutively fed, wherein the sheet interval D was controlled to be widened every 10 sheets as shown in Table 1. The temperature of the heater 6 was controlled to be 180° C.

TABLE 1

| No. of sheets | Interval (mm) |
|---|---|
| 1–10 | 50 |
| 11–20 | 95 |
| 21–30 | 140 |
| 31–40 | 185 |
| 41–50 | 230 |
| 51–60 | 275 |
| 61–70 | 320 |
| 71–80 | 365 |
| 81–90 | 410 |
| 91–100 | 455 |

Figure 2:
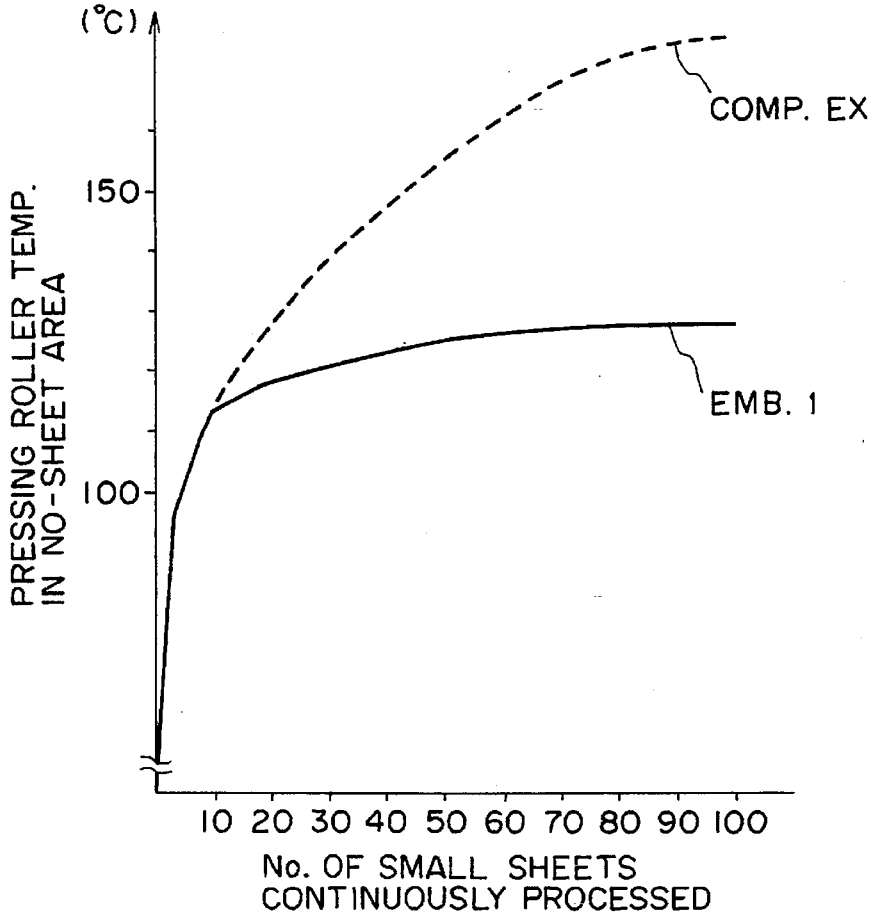
FIG. 2 is a graph presenting a comparison of the temperature in the non-sheet passage portion of the pressure roller between Embodiment 1 and a comparative example when the small size sheets are consecutively fed.

The temperature variation of the pressure roller 2 was measured at the non-sheet passage portion from the first sheet through the 100th sheet. The results are shown as a solid line in the graph of FIG. 2.

The temperature of the pressure roller 2 at the non-sheet passage portion remained below 130° C., and its difference from the temperature at the sheet passage portion, that is, 120° C., was small, causing no film damage nor wrinkling of the sheets.

Comparative Example

One hundred B5 size sheets were consecutively fed with the sheet interval being set at 50 mm. As a result, the temperature of the pressure roller 2 at the non-sheet passage portion exceeded 175° C. after the 100th sheet, as shown by the broken line in the graph of FIG. 2, and its difference from a temperature 120° C., that is, the temperature at the sheet passage portion, exceeded 55° C., which created a difference in the external diameter of the pressure roller 2, in the shaft direction; therefore, the fixing film 1 shifted toward one side, causing the film edge to be buckled, or wrinkling the AF size sheet fed immediately afterward.

As described in the foregoing, according to this embodiment, it is possible to make substantially uniform the heat distribution on the pressure roller 2 and fixing film 1 in the shaft direction, by widening gradually the sheet interval D for the small size sheet, that is, by lengthening gradually the sheet feeding cycle; whereby the damage to the fixing film or the wrinkling of the recording sheet can be prevented.

Figure 3:
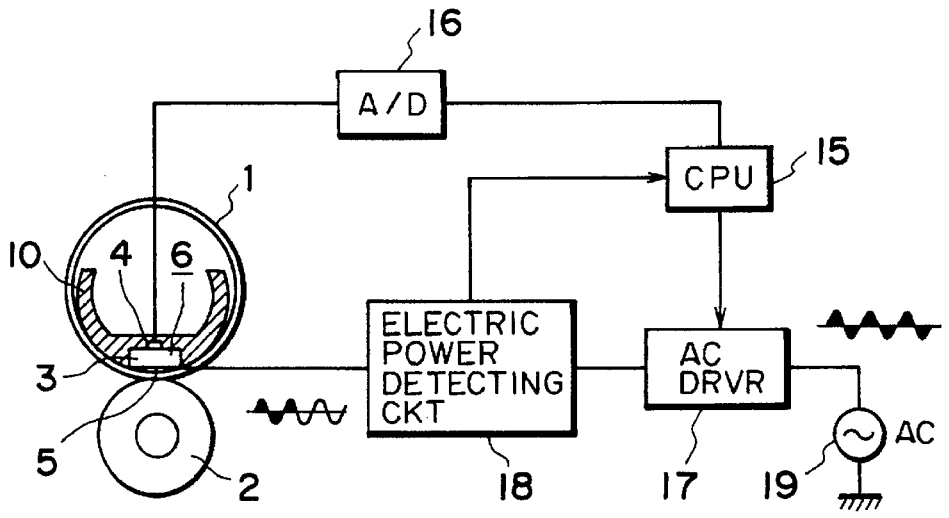
FIG. 3 is a block diagram of the control system of the apparatus in Embodiment 2.
Figure 4:
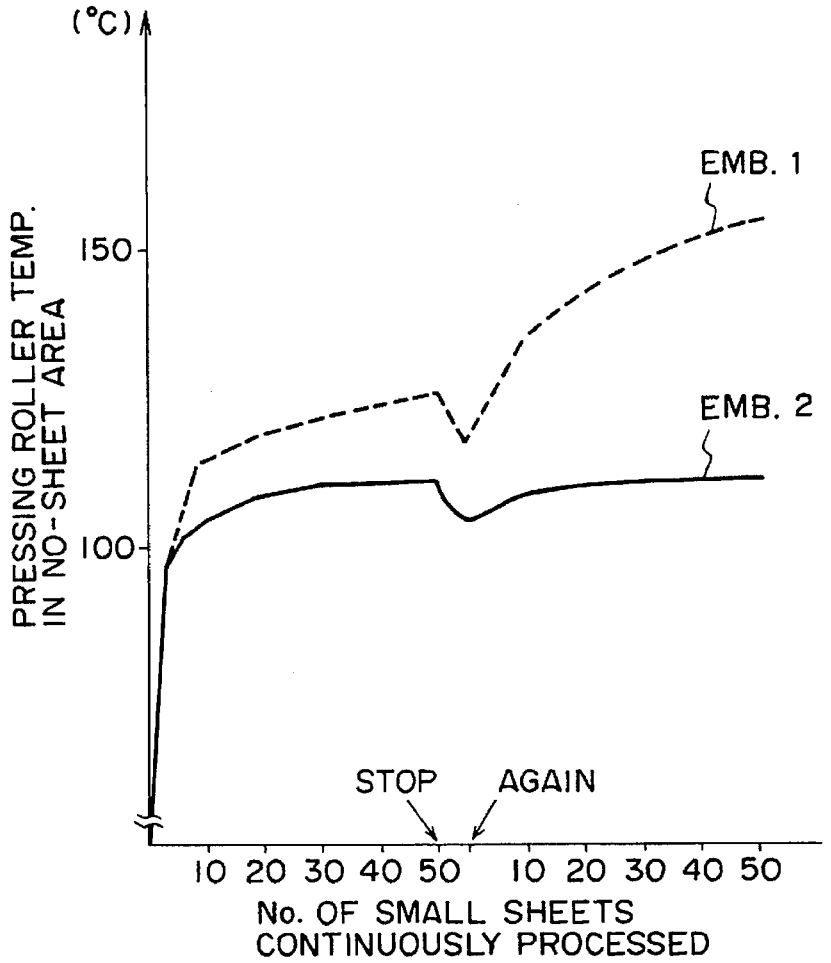
FIG. 4 is a graph presenting a comparison of the temperature in the non-sheet passage portion of the pressure roller between the apparatuses in Embodiments 1 and 2 when the small size sheets are consecutively fed.

Embodiment 2 (FIGS. 3 and 4)

In Embodiment 1 described above, the sheet interval D was simply switched every predetermined number of sheets. However, according to this method, the sheet interval D may end up being widened more than necessary, due to other parameters such as what kind of environment the apparatus is in, how warm the apparatus is immediately before the following sheet begins to be fed, or how long it takes for the apparatus to exchange the imaging data with the host computer, which may result in a reduced throughput.

In this embodiment, the power necessary for controlling the temperature of the heater 6 to be constant was detected, and the sheet interval D was controlled to be varied in response to this detected value of the power.

A block diagram of this control system is shown in FIG. 3. A CPU 15 takes in the output of the thermistor 4, through an A/D converter 16, and controls the power supply to the exothermic layer 5 of the heater 6, through an AC driver 17, whereby the temperature of the heater 6 is kept at a predetermined one. As for a power detection circuit 18, if it is of a type which controls the heater output based on the voltage of an AC input (AC power source) 19 and the wave number control, it measures the number of power supplying waves within a referential period, and computes the input power, the result of which is sent to the CPU.

If it is of a type which controls the heater output based on the phase control, all that is needed is to compute the input power based on the phase data and input voltage, the result of which is sent to the CPU.

For example, when the temperature of the heater 6 is controlled to be kept at a predetermined one with the use of the wave number control, both the fixing film 1 and pressure roller 2 have not been warmed up at the initial stage, and also, the ambient air is cool; therefore, the necessary amount of the power is large. However, as the entire fixing apparatus as well as the ambient air gradually warms up, the power necessary to keep the predetermined temperature decreases.

Thus, when the sheets are consecutively fed, a control is executed to reduce gradually the number of waves, corresponding to how warm the system is, wherein the sheet interval D is changed in response to this switching of the wave number.

Embodiment

As the AC power source 19, an AC power of 100 V and 50 Hz was used, and half a wave cycle was counted as a single wave unit, wherein ten cycles (20 wave units) were organized into a single control unit within which the number of wave units to be activated was varied. With such an arrangement in place, the number of wave units necessary to maintain the heater temperature at 155° C. was measured from the first sheet which was fed at the start up, at the room temperature, through the 100th sheet.

The results were that:

at the beginning, the temperature could not be maintained above 155° C. unless 14 wave units out of 20 were activated, but from the fifth sheet to ninth, 13 wave units were sufficient;

| | | |
|---|---|---|
| 10th | 17th | 12 |
| 18th | 31st | 11 |
| 32nd | 44th | 10 |
| 45th | 59th | 9 |
| 60th | 84th | 8 |
| 85th | 100th | 7; |

to maintain the temperature of 155° C.

In this control system, the predetermined temperature level is maintained by switching the number of wave units between an H level which is higher by a single wave unit than the minimum number of the wave units necessary to maintain the predetermined temperature, and an L level which is lower by a single wave unit than the minimum number of the wave units, wherein when the L level lasts longer than one second, the minimum number of the wave units is reduced by a single wave unit. The arrangement allows the power to be switched to reflect various conditions by which the fixing apparatus is affected, for example, the temperature of the pressure roller.

With such an arrangement in place, the small size sheets were consecutively fed, while the sheet interval D was controlled to be prolonged each time the power supply to the heater was reduced, as indicated in Table 2.

TABLE 2

| No. of Waves | 13 | 12 | 11 | 10 | 9 | 8 | 7 |
|---|---|---|---|---|---|---|---|
| Sheet Interval D (mm) | 50 | 110 | 170 | 230 | 290 | 350 | 420 |

In this embodiment, the basis on which the number of wave units was switched was employed as the basis on which the length of the sheet interval D was switched. In other words, how warm the fixing apparatus was and the ambient conditions were taken into consideration; therefore, this embodiment was more rational than the preceding Embodiment 1 in which the sheet interval D was increased solely on the basis of the number of sheets which had been fed, realizing a higher throughput and a safeguard against damages.

More specifically, in Embodiment I, when the feeding of the sheet was temporarily held after the 50th sheet, and then, was immediately restarted, the sheet counter was reset; therefore, there was a problem that the temperature increase in the non-sheet passage region became extreme. However, in this embodiment, how warm the fixing apparatus was was estimated from the necessary amount of the power, and the control was executed to select the sheet interval D in consideration of this estimation; therefore, even when the feeding of the sheets was restarted immediately after the interruption, the temperature increase never became extreme. The comparison between these two cases is given in FIG. 4.

In the preceding embodiments, the heater temperature was controlled to be constant, but an additional control may be executed in combination to lower gradually the heater temperature.

Figure 5:
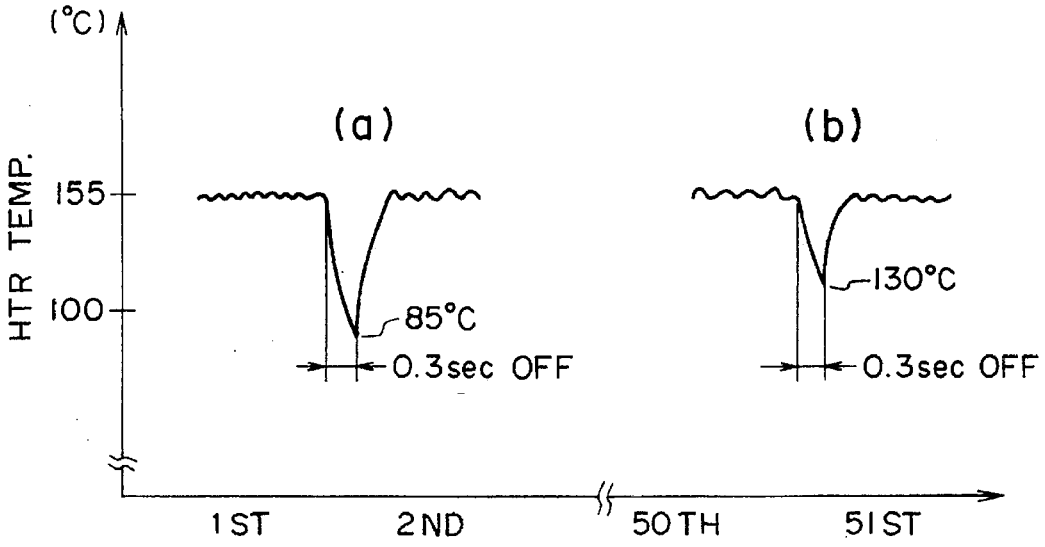
FIG. 5 is a heater temperature variation graph with subsections (a) and (b).

Embodiment 3 (FIG. 5)

In this Embodiment 3, the heater 6 was turned off for a predetermined period during the sheet interval D, wherein the length of the sheet interval D was determined in response to the amount of the temperature decrease which occurred during this predetermined period.

Subsection (a) of FIG. 5 shows the temperature drop in a case in which after the fixing apparatus was started up at a room temperature, the heater was turned off for 0.3 second during the sheet interval D between the first and second sheets, and subsection (b) of FIG. 5 shows the temperature drop in a case in which the heater was turned off for 0.3 second during the sheet interval D between the 50th and 51st sheets being consecutively fed.

In subsection (a) of FIG. 5, the temperature dropped to 85° C. while the heater was off for 0.3 second, but in subsection (b) of FIG. 5, it dropped only to 130° C. Therefore, it was possible to detect the thermal condition of the fixing apparatus, by turning off the heater during the sheet interval D, and then, measuring the temperature drop which occurred while the heater was off.

Thus, the sheet interval D was determined as shown in Table 3, based on the amount of temperature drop T which occurred during 0.3 second.

TABLE 3

| Temp. Drop T (deg) | Sheet Interval (mm) |
|---|---|
| $T > 60$ | 50 |
| $60 \geqq T > 50$ | 110 |
| $50 \geqq T > 40$ | 190 |
| $40 \geqq T > 30$ | 300 |
| $30 \geqq T$ | 420 |

When the small size sheets were consecutively fed while the sheet interval D was varied according to this Table 3, the same results as the preceding Embodiment 2 were obtained. Further, control became possible without relying on a complicated method such as detecting the amount of the power supplied.

Further, in this embodiment, the off-period of the heater was fixed, but instead, the time it takes for the temperature to drop a predetermined temperature range, for example, 150° C. to 140° C., may be measured. In short, what is necessary is to measure the rate of the temperature drop.

Further, the rate of the temperature increase may be measured while the heater temperature is increased after the off-period, and when the rate increases, it is determined that the temperature of the apparatus is higher, whereby the control is executed to widen the sheet interval D.

In the preceding embodiment, the heater is turned off during the sheet interval D, but instead, the amount of heat may be increased for a predetermined period, and then, the amount of the temperature increase which occurs during this predetermined period may be measured to determine how warm the fixing apparatus is, based on which the control is executed to widen the sheet interval D.

Embodiment 4

In the foregoing, Embodiment 3 was described with reference to a fixed control temperature, but if an additional control is executed in combination in which the control temperature is lowered in response to how warm the fixing apparatus is, the amount by which the sheet interval D is widened can be reduced. This is convenient for the user, and in addition, is preferable from the standpoint of safety and durability of the apparatus.

When the control temperature was sequentially lowered from 155° C. to 150° C., then, to 145° C., and so on, the heater temperature increase at the non-sheet passage portion became smaller by more than 10 degrees, whereby the sheet interval D could be widened less by the corresponding amount.

Table 4 offers a comparison between Embodiment 3 and this embodiment of the sheet interval D which was required to reduce below 130° C. the temperature of the pressure roller 2, at the non-sheet passage portion.

TABLE 4

| | Embodiment 3 | Embodiment 4 | |
|---|---|---|---|
| Temp. Drop T (deg.) | Sheet interval D (mm) | Sheet interval D (mm) | Cont. temp. (°C.) |
| T > 60 | 50 | 50 | 155 |
| 60 ≧ T > 50 | 110 | 80 | 155 |
| 50 ≧ T > 40 | 190 | 150 | 150 |
| 40 ≧ T > 30 | 300 | 200 | 150 |
| 30 ≧ | 420 | 300 | 145 |

As is evident from the table, the throughput can be increased further than the preceding embodiment.

Embodiment 5

In the preceding embodiment, the heater was turned off for a predetermined period during the sheet interval D, but this off-period may be gradually prolonged as the fixing apparatus becomes warmer.

This arrangement decreases the amount of heat supplied to the non-sheet passage portions of the pressure roller 2 and fixing film 1 during the sheet interval D, which in turn decreases the amount of the temperature increase in the non-sheet passage portions; therefore, the amount by which the sheet interval D is increased can be reduced compared to the preceding embodiment.

TABLE 5

| Temp. Drop T (0.3 sec) | Sheet interval off period (sec) | Sheet interval (mm) |
|---|---|---|
| T > 60 | 0.3 | 50 |
| 60 ≧ T > 50 | 1.5 | 70 |
| 50 ≧ T > 40 | 3 | 130 |
| 40 ≧ T > 30 | 5 | 170 |
| 30 ≧ T | 7 | 250 |

Thus, the throughput can be maintained higher than the preceding embodiment, which is convenient for the user.

Further, instead of turning off the heater completely, the heater temperature may be controlled to be kept at 155° C. only while the sheet is in contact with the heating portion of the fixing apparatus, and at substantially 130° C. during the sheet interval, and then, may be again increased to 155° C. by the time when the following sheet enters the fixing nip N. This arrangement can also prevent the heater temperature from dropping excessively.

As described in the preceding Embodiments 1 to 5, the problems such as damage to the fixing film, wrinkling of the recording sheets, or high temperature off-set caused by the excessive temperature increase at the non-sheet passage portion, which may occur when the small size sheets are consecutively fed, were solved.

Figure 6:
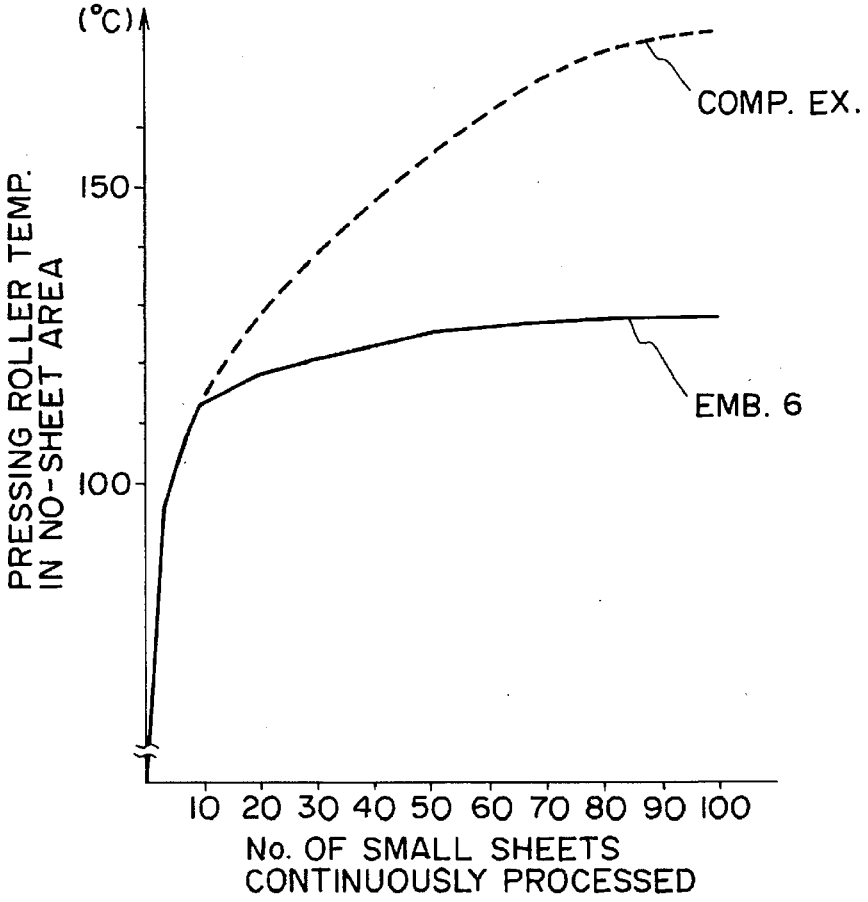
FIG. 6 is a graph presenting a comparison of the temperature in the non-sheet passage portion of the pressure roller between the apparatuses in Embodiment 6 and the comparative example.

Embodiment 6 (FIG. 6)

In this embodiment, an image forming apparatus comprising the same image heating apparatus as the one in Embodiment 1 shown in FIG. 1 was used, wherein the letter size or A4 size sheets were fed with a sheet interval D of 50 mm, but when the small size sheets such as the B5 or envelop size sheets which were identified as the small size sheets, based on the sheet size signal, the number of the consecutively fed sheets were counted, and when the number reached a specific count predetermined for each sheet size, a control was executed to interrupt the printing operation.

Embodiment

The sheet count was established for each sheet size as shown in Table 6, at which the continuous printing is interrupted. The target temperature of the heater 6 was set at 180° C.

TABLE 6

| Sheet size | No. up to print stop |
|---|---|
| A4/letter | ∞ |
| B5 | 300 |
| A4 | 100 |
| Envelope | 50 |

The results were such that the temperature of the pressure roller 2 at the non-sheet passage portion remained below 130° C., displaying a smaller temperature difference from the temperature at the sheet passage portion, that is, 100° C., and there was no damage to the film and no sheet wrinkle. The results of measuring the temperature of the pressure roller 2 at the non-sheet passage portion were given as the solid line in the graph shown in FIG. 6.

Comparative case

One hundred B5 size sheets were consecutively fed with a fixed sheet interval D of 50 mm.

As shown by the broken line in the graph in FIG. 6, the results were such that the temperature of the pressure roller 2 at the non-sheet passage portion exceeded 165° C. after 100 sheets were fed, creating a temperature difference of more than 65° C. from the temperature at the sheet passage portion, that is, 100° C.; therefore, the external diameter of the pressure roller 2 became different in the shaft direction, causing the fixing film 1 to shift to a side. As a result, the film edge was buckled or wrinkles appeared on the A4 sheet fed immediately afterward.

As described in the foregoing, according to this embodiment, when the small size sheets are consecutively fed, the continuous printing operation is interrupted at a specific sheet count predetermined for each sheet size, to suppress the temperature increase of the pressure roller 2 at the non-sheet passage portion so that the damages to the fixing film and the wrinkling of the recording sheet can be prevented.

Figure 7:
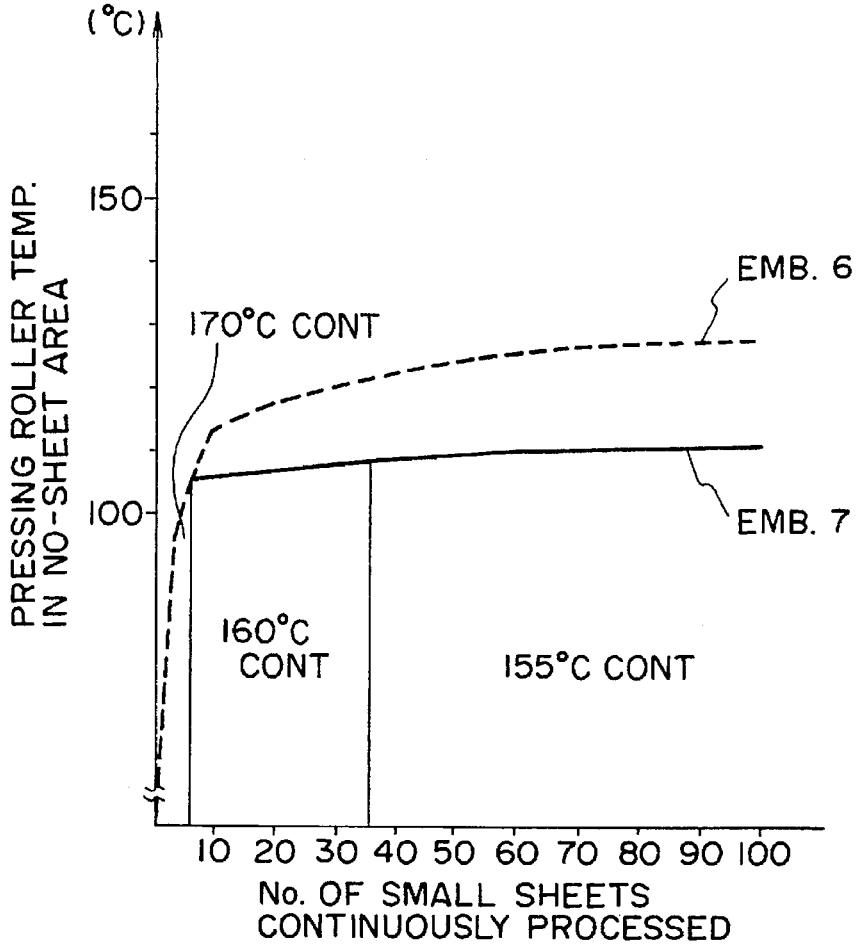
FIG. 7 is a graph presenting a comparison of the temperature in the non-sheet passage portion of the pressure roller between the apparatuses in Embodiments 7 and 6.

Embodiment 7 (FIG. 7)

In the preceding Embodiment 6, the target temperature of the heater was fixed at 180° C., but it is possible to lower this target temperature as the fixing film 1, pressure roller 2, and the like component are gradually warmed up through the continuous printing operation.

In this embodiment in which a control was executed to lower gradually the target temperature from, for example, 180° C. to 160° C., then, to 155° C., and so on, the sheet count at which the printing operation was interrupted was determined by beginning counting the number of the sheet fed after the target temperature was lowered to 155° C.

The sheet count at which the printing operation was interrupted was established for each sheet size, as shown in FIG. 7.

TABLE 7

| Size | No. upto print stop |
|---|---|
| A4/letter | ∞ |
| B5 | 600 |
| A4 | 400 |
| Envelope | 200 |

By executing a control to lower the target temperature by 15 degrees, the temperature increase at the non-sheet passage portion became smaller by approximately 20 degrees. Therefore, the problematic temperature increase became smaller compared to the preceding Embodiment 6, whereby the sheet count before the printing operation was stopped was increased, making the apparatus much easier for the user to operate.

Figure 8:
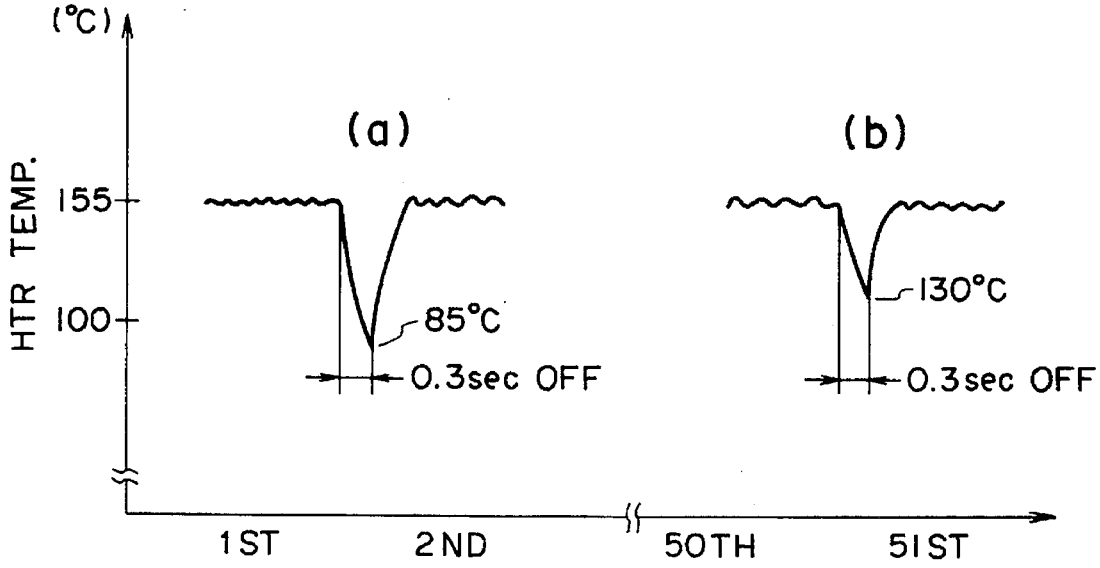
FIG. 8 is a heater temperature variation graph with subsections (a) and (b).

Embodiment 8 (FIG. 8)

In this embodiment, an off-period was provided for the heater during the sheet interval, and whether or not the printing operation was to be stopped was determined based on the temperature change after the off-period.

Subsection (a) of FIG. 8 shows the temperature drop in a case in which after the fixing apparatus was started up at a room temperature, the heater was turned off for 0.3 second during the sheet interval D between the first and second sheets, and subsection (b) of FIG. 8 shows the temperature drop in a case in which the heater was turned off for 0.3 second during the sheet interval D between the 50th and 51st sheets being consecutively fed.

In subsection (a) of FIG. 8, the temperature dropped to 85° C. while the heater was off for 0.3 second, but in subsection (b) of FIG. 8, it dropped only to 130° C. Therefore, it is possible to detect how warm the fixing apparatus is, by turning off the heater for a predetermined period during the sheet interval D, and then, measuring the temperature afterward. Thus, the temperature at which the printing operation was to be shut off was determined as shown in Table 8, based on the temperature measured 0.3 second after the heater was turned off.

TABLE 8

| Sheet size | Temp. for print stop |
|---|---|
| A4/letter | none |
| B5 | 140 |
| A4 | 135 |
| Envelope | 130 |

As is evident from the table, the smaller the sheet size is, the faster the temperature rises at the non-sheet passage portion; therefore, the sooner the printing operation is stopped, the more preferable it is, so that damage which may be caused by the temperature increase at the non-sheet passage portion can be prevented. Further, a control may be executed to reduce the amount of the heat generated by the heater, instead of turning off the heater.

Embodiment 9

In this embodiment, an off-period was provided for the heater during the sheet interval in the same manner as in Embodiment 8, during which whether or not the printing operation was to be stopped was determined based on the rate at which the temperature dropped.

More specifically, it is possible to detect how warm the fixing apparatus is, by turning off the heater during the sheet interval, and then, measuring the rate at which the temperature drops.

Thus, in this embodiment, whether or not the printing operation was to be stopped was determined as shown in Table 9, based on the rate at which the temperature dropped during the 0.3 second.

TABLE 9

| Sheet size | Temp. Drop rate for print stop |
|---|---|
| A4/letter | none |
| B5 | 85 deg/sec |
| A4 | 90 deg/sec |
| Envelope | 95 deg/sec |

Further, in this embodiment, the duration of the off-period for the heater was fixed, but instead, the time it takes for the temperature to drop a predetermined temperature range, for example, from 150° C. to 140° C., may be measured. In short, all that is necessary is to measure the rate at which the temperature drops.

Further, the rate at which the temperature rises after the heater is reactivated after the off-period may be measured, and when the rate increases, it is determined that the temperature at the non-sheet passage portion has increased, and a control is executed to stop the printing operation.

In the preceding embodiment, the heater was turned off during the sheet interval, but instead, the amount of the heat may be increased for a predetermined period, during which the amount of the temperature increase is measured to determine how high the temperature at the non-sheet passage portion is, and a control is executed to stop the printer, based on this measurement.

Embodiment 10

In the preceding Embodiments 6–9, the printing operation was stopped when it was determined that the temperature increase at the non-sheet passage portion became excessive while the small size sheets were consecutively fed. At this time, a display recognizable to the user can be presented, or a signal can be sent to the host computer or the like connected to the apparatus, which offers the benefit of informing the user of the apparatus status so that perplexing or confusing him it can be avoided.

Embodiment 11

This embodiment relates to a method for releasing the apparatus from a print-lock status which might have occurred in Embodiments 6–10.

As far as the user is concerned, it is preferable for the apparatus to be automatically released from the print-lock status as soon as the temperature at the non-sheet passage portion sufficiently drops after the printing operation is stopped.

It has been presumed that the temperature at the non-sheet passage portion cannot be detected by the previous method of positioning a single thermistor at a location which falls within the passages of the recording materials of all sizes.

However, as was described in the cases of Embodiments 6–10, the temperature increase at the non-sheet passage portion could be indirectly measured by identifying the sheet size, counting the number of the consecutively fed sheets, or measuring the temperature variation when the heater was turned off during the sheet interval.

In reversal, this means that the temperature drop at the non-sheet passage portion can be estimated from the temperature variation after the printing stoppage, the number of the prints before the time of the printing stoppage, or the elapsed time after the printing stoppage.

Therefore, all that is needed is to execute a control so that the apparatus is enabled to print when it is determined, based on the value or values of the above mentioned parameters, that the temperature at the non-sheet passage portion has dropped below, for example, 80° C.

As was described in the cases of the preceding Embodiments 6–10, the problems such as damage to the fixing film, wrinkling of the recording materials, or high temperature off-set caused by the excessive temperature increase at the non-sheet passage portion, which may occur when the small size sheets are consecutively fed, can be solved.

Figure 10:
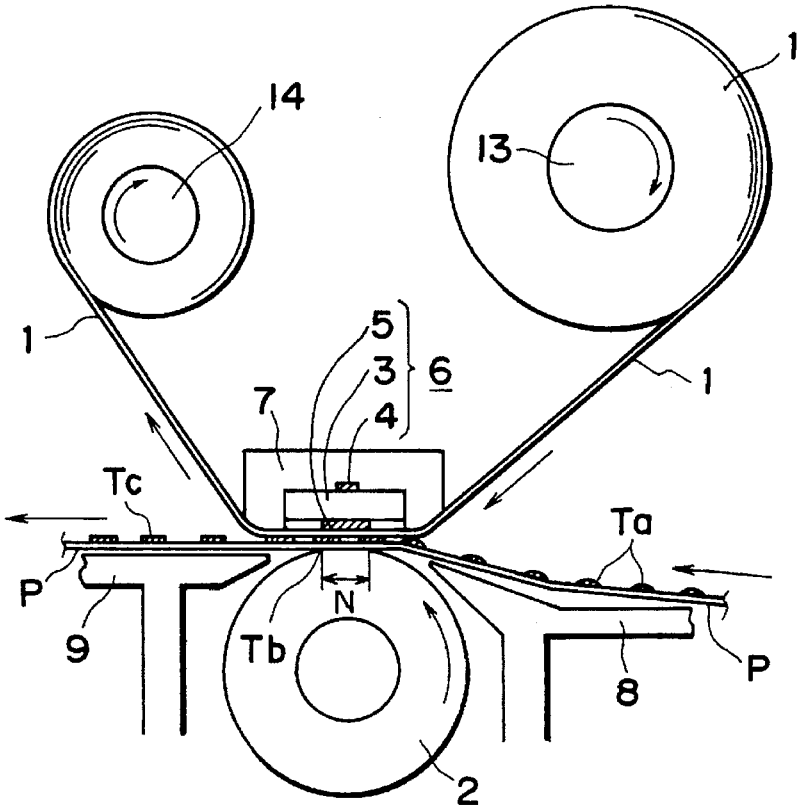
FIG. 10 is a sectional view of an alternative embodiment of the image heating apparatus in accordance with the present invention.

FIG. 10 shows an alternative embodiment of the image heating apparatus in accordance with the present invention, in which a roll of non-endless film is employed in place of the endless one.

While the invention has been described with reference to the structures disclosed therein, it is not confined to the details set forth and this application is intended to cover such modifications or changes as may come within the purposes of the improvements or the scope of the following claims.

What is claimed is:

1. An image heating apparatus comprising:

a heater which is stationary in use;

a film slidable on said heater;

a backup member cooperable with said heater to form a nip, with said film being interposed between said backup member and said heater, wherein an image carried on a recording material is heated through said film while in the nip by heat from said heater; and feeding interval controlling means for varying the recording material interval, wherein said control means expands the feeding interval each time the consecutive feeding of the recording material reaches a predetermined number as the recording materials are being consecutively fed.

2. An apparatus according to claim 1, wherein the number when the feeding interval is switched is different depending on the size of the recording material.

3. An apparatus according to claim 1, further comprising a temperature detecting element for detecting the temperature of the heater, said element detecting the heater temperature adjacent a recording material feeding position reference in a longitudinal direction of said heater.

4. An apparatus according to claim 3, further comprising power supply control means for maintaining a predetermined temperature of said heater.

5. An apparatus according to claim 1, wherein said apparatus thermally fixes an unfixed image carried on the recording material.

6. An image heating apparatus comprising:

a heater which is stationary in use;

a film slidable on said heater;

a backup member cooperable with said heater to form a nip, with said film being interposed between said backup member and said heater, wherein an image carried on a recording material is heated through said film while in the nip by heat from said heater;

electric power level detecting means for detecting electric power level supplied to said heater; and feeding interval controlling means for varying the recording material interval, wherein said feeding interval controlling means controls the feeding interval in response to an output of said electric power level detecting means as the recording materials are being consecutively fed.

7. An apparatus according to claim 6, wherein said apparatus thermally fixes an unfixed image carried on the recording material.

* * * * *

UNITED STATES PATENT AND TRADEMARK OFFICE

CERTIFICATE OF CORRECTION

PATENT NO. : 5,669,039
DATED : September 16, 1997
INVENTOR(S) : Yasumasa OHTSUKA, et al.

It is certified that error appears in the above-indentified patent and that said Letters Patent is hereby corrected as shown below:

Title Page, [56] References Cited:
delete "Klugen" and insert therefor --Kluger--.

Column 1:
Line 40, delete "nnshown" and insert therefor --unshown--.

Column 2:
Line 31, delete "mat" and insert therefor --may--;
Line 46, delete "tone image" and insert therefor --toner image--.

Column 7:
Line 10, after "7", delete the semicolon (";");
Line 47, delete "I" and insert therefor --1--;
Line 52, after "was" (first occurrence), insert a comma (",").

Signed and Sealed this

Seventeenth Day of March, 1998

*Attest:*

*Attesting Officer*

BRUCE LEHMAN

*Commissioner of Patents and Trademarks*